US008381748B2

(12) United States Patent
Martin

(10) Patent No.: US 8,381,748 B2
(45) Date of Patent: Feb. 26, 2013

(54) WALKING AND PICKUP STICK

(75) Inventor: Shanon Matthew Martin, Palmerston North (NZ)

(73) Assignee: Richard Selwyn Jebson, Palmerston North (NZ)

( * ) Notice: Subject to any disclaimer, the term of this patent is extended or adjusted under 35 U.S.C. 154(b) by 5 days.

(21) Appl. No.: 12/975,863

(22) Filed: Dec. 22, 2010

(65) Prior Publication Data

US 2011/0155195 A1 Jun. 30, 2011

(30) Foreign Application Priority Data

Dec. 24, 2009 (NZ) ..... 582351

(51) Int. Cl.
*A45B 3/00* (2006.01)

(52) U.S. Cl. ..... 135/66; 135/72; 135/80; 135/84; 294/104

(58) Field of Classification Search ..... 135/65–66, 135/70, 72, 80–71, 911, 75, 84; 294/104–106, 294/115, 192; 248/155, 188.9; 223/118–119
See application file for complete search history.

(56) References Cited

U.S. PATENT DOCUMENTS

| | | | | |
|---|---|---|---|---|
| 3,669,133 | A * | 6/1972 | Hyman | 135/74 |
| 4,709,839 | A * | 12/1987 | Tucker | 223/119 |
| 4,962,957 | A * | 10/1990 | Traber | 294/100 |
| 5,192,104 | A * | 3/1993 | Lin | 294/104 |
| 5,392,800 | A * | 2/1995 | Sergi | 135/65 |
| 5,636,650 | A * | 6/1997 | Kroeze | 135/66 |
| 5,640,985 | A * | 6/1997 | Snyder et al. | 135/65 |
| 6,386,216 | B1 * | 5/2002 | Cubelli | 135/66 |
| 6,513,844 | B1 * | 2/2003 | Hsu | 294/210 |
| 6,550,490 | B1 * | 4/2003 | Morton et al. | 135/66 |
| 7,201,401 | B1 * | 4/2007 | Friedman | 280/823 |
| 7,243,668 | B1 * | 7/2007 | Kroeze | 135/77 |
| 7,287,675 | B1 * | 10/2007 | Sullivan et al. | 223/111 |
| 7,934,756 | B2 * | 5/2011 | Kroeze | 294/210 |
| 2009/0032077 | A1 | 2/2009 | Hines | |

FOREIGN PATENT DOCUMENTS

| | | |
|---|---|---|
| CN | 2781856 | 5/2006 |

* cited by examiner

*Primary Examiner* — Winnie Yip
(74) *Attorney, Agent, or Firm* — James Creighton Wray

(57) ABSTRACT

A combined walking and pickup stick includes a shaft, pickup mechanism and actuator assembly. The actuator assembly controls configuration of the stick as either a walking stick or a pickup stick and also controls operation of the pickup stick. The stick has an adjustable length, but adjustment of the length does not affect operation of the pickup mechanism. The stick also folds for easy storage or transport.

17 Claims, 13 Drawing Sheets

WALKING AND PICKUP STICK

This application claims the benefit of New Zealand Application No. 582351 filed Dec. 24, 2009, which is hereby incorporated by reference in its entirety as if fully set forth herein.

FIELD OF THE INVENTION

The invention relates to combined walking and pickup sticks.

BACKGROUND TO THE INVENTION

Walking sticks are commonly used by those requiring support when walking. Walking sticks are available in various lengths and configurations.

Pickup sticks allow users to pick up objects (e.g. litter) from the ground without bending down. Pickup sticks usually include a jaw at a lower end which is controlled by a trigger mechanism positioned at the other end of the stick. In this specification, the term "pickup stick" also includes reaching aids. Reaching aids can be useful for those with impaired mobility, improving their reach and allowing easier access to high shelves and the like.

Combined walking and pickup sticks are also known, but these suffer from a number of deficiencies and do not operate well as both walking sticks and pickup sticks.

It is an object of the invention to provide an improved combined walking and pickup stick, or at least to provide the public with a useful choice.

SUMMARY OF THE INVENTION

In a first aspect the invention provides a combined walking and pickup stick including: a shaft; a pickup mechanism at or near one end of the shaft; an actuator assembly at or near the other end of the shaft; an actuation line running from the actuator assembly along the shaft to the pickup mechanism; and two or more movable turning points at least partly defining a path of the actuation line; wherein movement of one or more of the moveable turning points alters the path of the actuation line such that one or both ends of the actuation line are either moved by applied tension or allowed to move by released tension.

Preferably the actuator assembly includes first and second actuators each configured, in use, to cause movement of one or more of the movable turning points.

Preferably the first and second actuators include two levers. Preferably the two levers rotate about a common pivot axis.

Preferably the first actuator is a handle and the second actuator is a trigger.

Preferably the first actuator controls configuration of the combined walking and pickup stick as either a walking stick or a pickup stick.

Preferably movement of the first actuator from a neutral position to an operative position results in movement of one or more of the movable turning points, the resulting alteration in the path of the actuation line causing or allowing movement of the pickup mechanism from a stowed position, in which the stick is configured as a walking stick, to an unstowed position, in which the stick is configured as a pickup stick.

Preferably when the first actuator is in the operative position and the pickup mechanism is in the unstowed position, movement of the second actuator from a first position to a second position causes or allows movement of the pickup mechanism from the unstowed position towards a pickup position.

Preferably movement of the second actuator from the first position to the second position is possible only when the first actuator is in the operative position.

Preferably movement of the first actuator from the operative position to the neutral position results in movement of one or more of the movable turning points, the resulting alteration in the path of the actuation line causing or allowing movement of the pickup mechanism from the unstowed position to the stowed position.

Preferably the last movable turning point about which the actuation line passes before running to the pickup mechanism is moved by the second actuator.

Preferably the shaft includes a number of joints such that it can be folded, disassembly of the joints for folding of the shaft being enabled by release of tension through movement of one or more of the movable turning points and/or manual movement of the pickup mechanism. Preferably the joints are ferrule-type joints.

Preferably the shaft is an adjustable length shaft.

Preferably adjustment of the length of the shaft results in an increase or decrease in the length of an actuation line path between the actuator assembly and the pickup mechanism and a corresponding decrease or increase in the length of an actuation line path elsewhere in the stick such that the total actuation line path length is unchanged and operation of the pickup mechanism is unaffected by the adjustment of the length of the shaft.

Preferably the increase and decrease of actuation path lengths occur as a consequence of adjustment of the length of the shaft, without the need for manual adjustment of actuator line path or length.

Preferably the combined walking and pickup stick includes a fixing arrangement configured to fix the length of the shaft at a desired length. Preferably the fixing arrangement is configured to fix the length of the shaft at one of a number of incremental lengths. Preferably the fixing arrangement includes a projection and cooperating holes in an inner sleeve and an outer sleeve of the shaft, the cooperating holes receiving the projection in order to fix the length of the shaft.

In a second aspect the invention provides a combined walking and pickup stick including: an adjustable length shaft; a pickup mechanism at or near one end of the shaft; an actuator assembly at or near the other end of the shaft; and an actuation line fastened at a first end to a point on the walking and pick up stick and running from the first end via the actuator assembly and along the shaft to the pickup mechanism, a second end of the actuation line being connected to the pickup mechanism such that, in use, operation of the actuator assembly results in actuation of the pickup mechanism.

Preferably adjustment of the length of the shaft results in an increase or decrease in the length of an actuation line path between the actuator assembly and the pickup mechanism and a corresponding decrease or increase in the length of an actuation line path elsewhere in the stick such that the total actuation line path length is unchanged and operation of the pickup mechanism is unaffected by the adjustment of the length of the shaft.

Preferably the increase and decrease of actuation path lengths occur as a consequence of adjustment of the length of the shaft, without the need for manual adjustment of actuator line path or length.

Preferably the combined walking and pickup stick includes a fixing arrangement configured to fix the length of the shaft at a desired length. Preferably the fixing arrangement is configured to fix the length of the shaft at one of a number of incremental lengths. Preferably the fixing arrangement includes a projection and cooperating holes in an inner sleeve and an outer sleeve of the shaft, the cooperating holes receiving the projection in order to fix the length of the shaft.

BRIEF DESCRIPTION OF THE DRAWINGS

The invention will now be described by way of example only, with reference to the accompanying drawings, in which.

DETAILED DESCRIPTION

Figure 1:
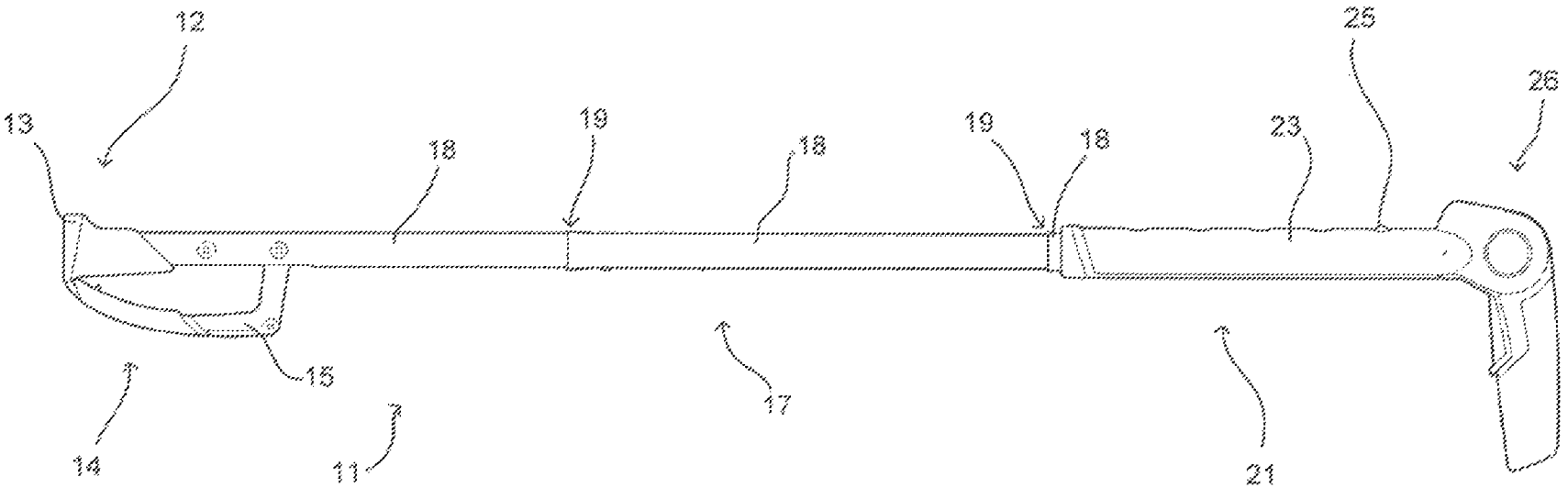
FIG. 1 is a side view of a combined walking and pickup stick according to one embodiment.
Figure 2:
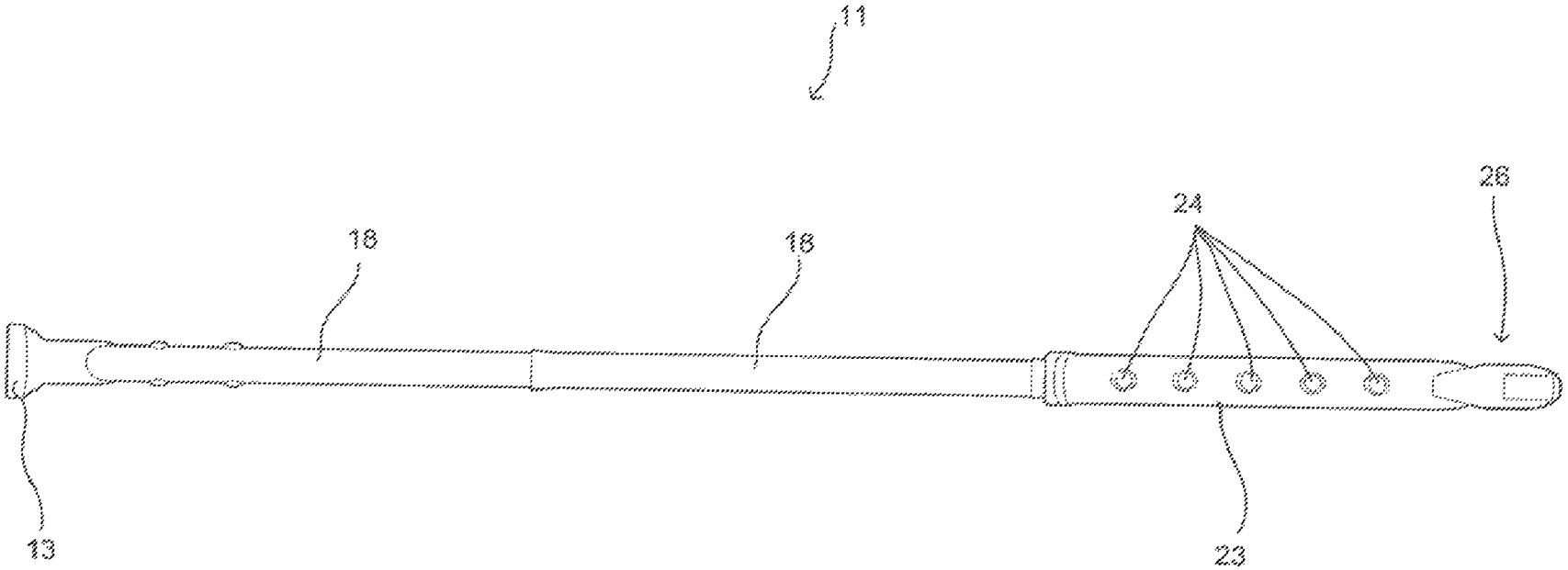
FIG. 2 is a front view of the stick of FIG. 1.
Figure 3:
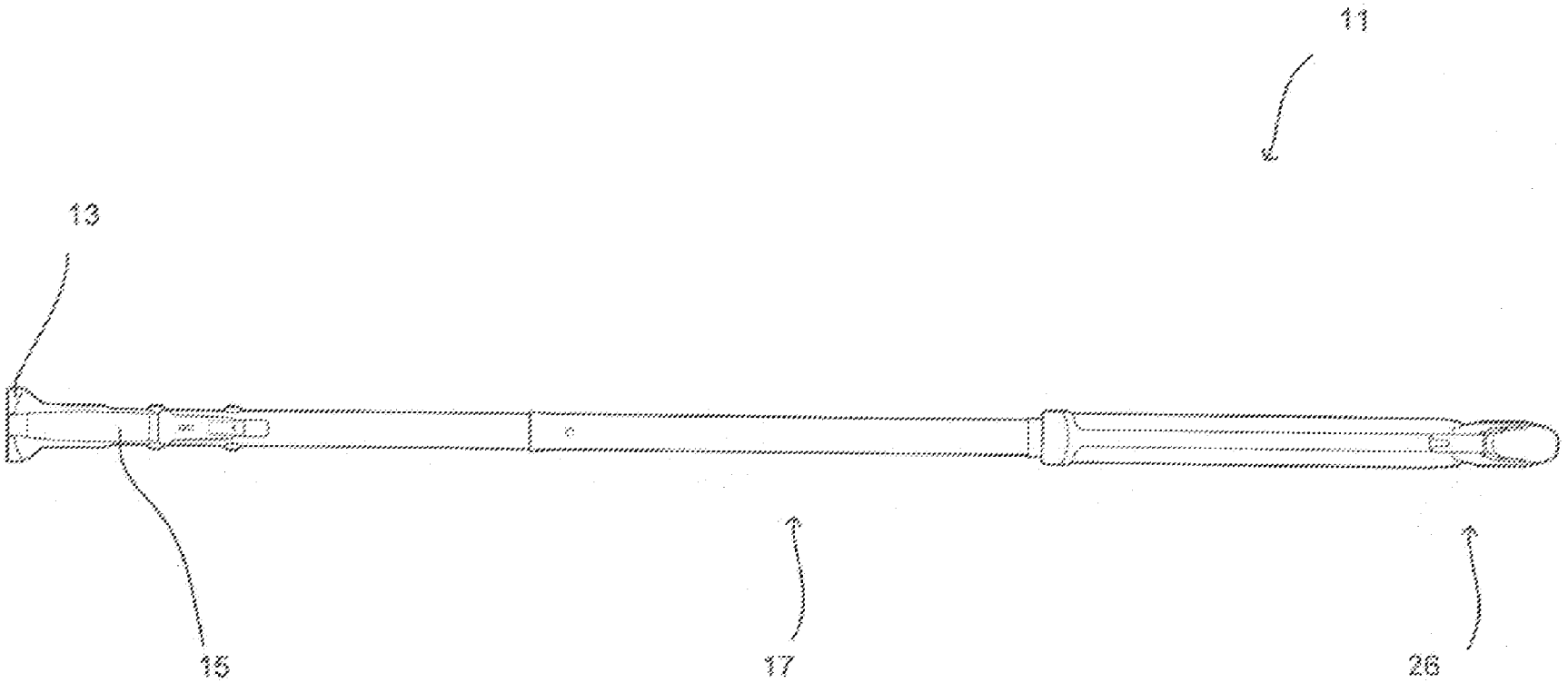
FIG. 3 is a back view of the stick of FIG. 1.
Figure 4:
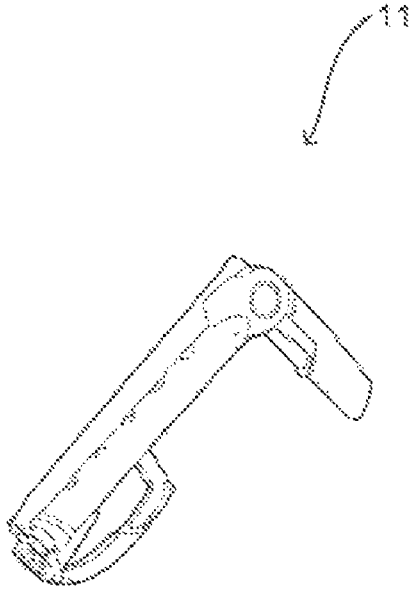
FIG. 4 is a perspective view showing the stick of FIG. 1 in a folded state.
Figure 5:
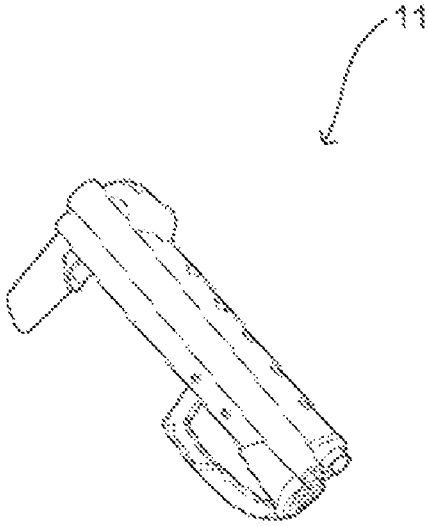
FIG. 5 is a further perspective view of the stick of FIG. 1 in a folded state.

FIGS. 1 to 6 shows a folding combined walking and pick up stick according to one embodiment 11. The stick includes a lower end 12, which in the embodiment shown is equipped with a rubber foot 13. Various other types of base material, or different bases may be suitable. A pickup mechanism 14 is also provided at or near the lower end 12. The pickup mechanism 14 in one embodiment includes a jaw 15 which pivots with respect to the shaft 17 of the stick 11. The tip of the jaw 15 may meet the edge of the rubber foot 13 in a stowed position as shown in FIG. 1.

The shaft 17 may be formed from two or more sections 18 connected by joints 19. The joints 19 may be ferrule-type joints or any other suitable kind of joint. The joints 19 allow the shaft 17 to be taken apart, such that the stick 11 can be folded for easy storage or transportation in a car or bag. The stick 11 is shown in a folded state in FIGS. 4 and 5. The folding of the stick 11 will be described in greater detail below.

The shaft includes an upper portion 21 where an inner sleeve 18 slides within an outer sleeve 23. As can be seen most clearly in FIG. 2, the outer sleeve has a series of holes 24, and a protrusion 25 (FIG. 1) mounted in or to the inner sleeve engages with one of these holes 24. This allows the length of the shaft 11 to be adjusted, as will be described in greater detail below.

The stick 11 also includes an actuator assembly 26 at or near the upper end. The actuator assembly 26 in the embodiment shown acts as a handle when the stick is used as a walking stick and as a handle and actuator arrangement when the stick is used as a pickup stick. Operation of the actuator assembly 26 will be described in detail below.

Figure 6:
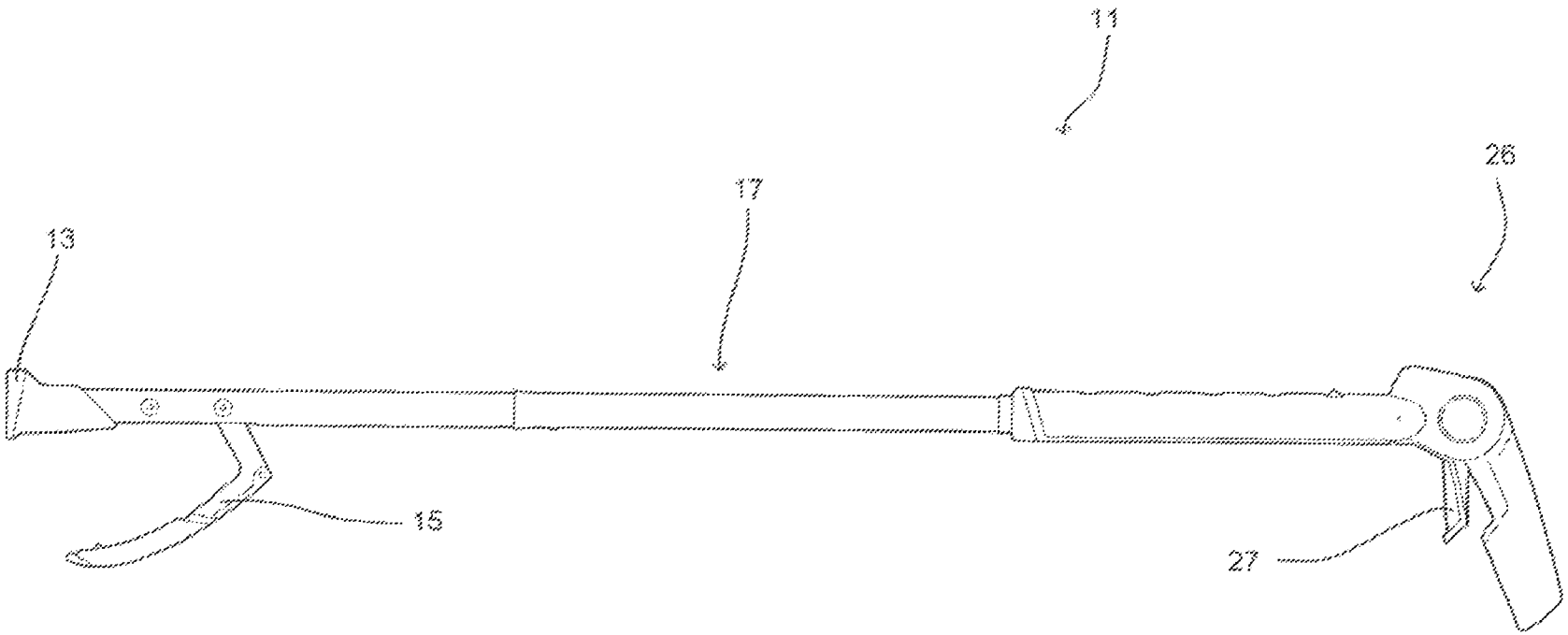
FIG. 6 is a side view of the stick of FIG. 1, with the pickup mechanism in an unstowed position.

FIG. 6 shows the walking and pickup stick with the pickup mechanism in an unstowed position. In this position, operation of the trigger 27 will result in movement of the pickup jaw 15 back towards the rubber foot 13.

FIGS. 7 to 10 are a series of cross-sections showing how the pickup mechanism functions. These figures show a non-folding shaft 17, but the shaft could equally be a folding shaft formed from a number of sections 18 as discussed above and below.

Figure 7:
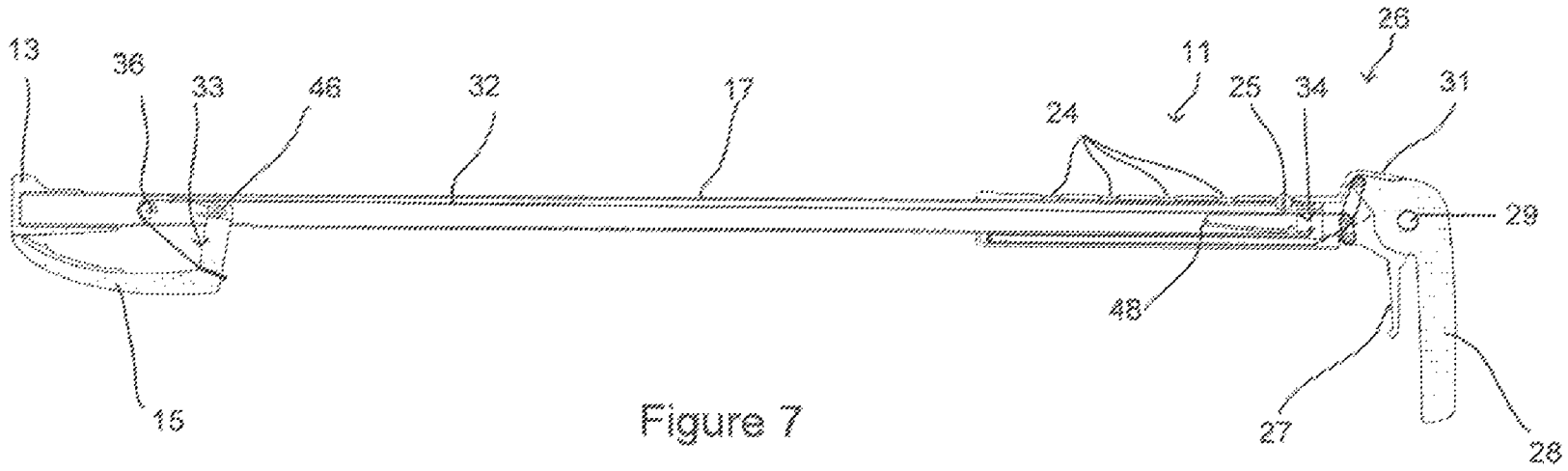
FIG. 7 is a cross-section along the length of a stick according to a further embodiment, in a walking stick configuration.

FIG. 7 shows the walking and pickup stick 11 in a walking stick configuration. The pickup jaw 15 is in a stowed position against the base of the rubber foot 13. The actuator assembly includes a first actuator, in the form of a handle 28, and a second actuator in the form of a trigger 27. The handle 28 and trigger 27 are first and second levers which preferably rotate around a common axis 29. In FIG. 7 the handle 28 is in a neutral position and is preferably maintained in this position by a stop. The stop may be provided by an external stop, or preferably by an arrangement of internal splines on the handle that cooperate with splines on a sprung push button arranged in the side of the handle. When the push button is pressed the splines release, allowing rotation of the handle 28. When the push button is released the splines engage, preventing further rotation of the handle.

As FIG. 7 shows, an actuation line 32 is connected at a first, lower end 33 and at a second, upper end 34 near the top of the walking and pickup stick 11. The actuation line 32 runs along the shaft 17 from the first end 33, through the actuation assembly 26 to the second end 34. The actuation line preferably runs along the inside of the shaft 17 but may run along the outside of the shaft 17. Near the lower end of the stick 11 the actuation line 32 passes around a lower turning point 36, such that tension forces from the actuation line 32 tend to pull the jaw 15 towards the shaft 17 and rubber foot 13.

A number of other turning points are included and will be described below. In general, a turning point is a point where the path of the actuation line turns. Each turning point at least partly defines the path of the actuation line. A turning point may be a pin, bush, pulley, spindle, groove, projection or any other suitable element capable of providing a turn in the actuation line path. A turning point may be a static turning point (e.g. a pin or projection which does not rotate) or a rotating turning point (e.g. a rotating bush or pulley which will rotate as the actuation line moves over it). A turning point may be a fixed turning point (where the position or axis of the turning point does not move in ordinary operation of the stick 11) or a moveable turning point (where the position or axis of the turning point moves to provide or contribute to some function of the stick 11). Either a fixed or moveable turning point may be a static or rotating turning point.

Figure 8:
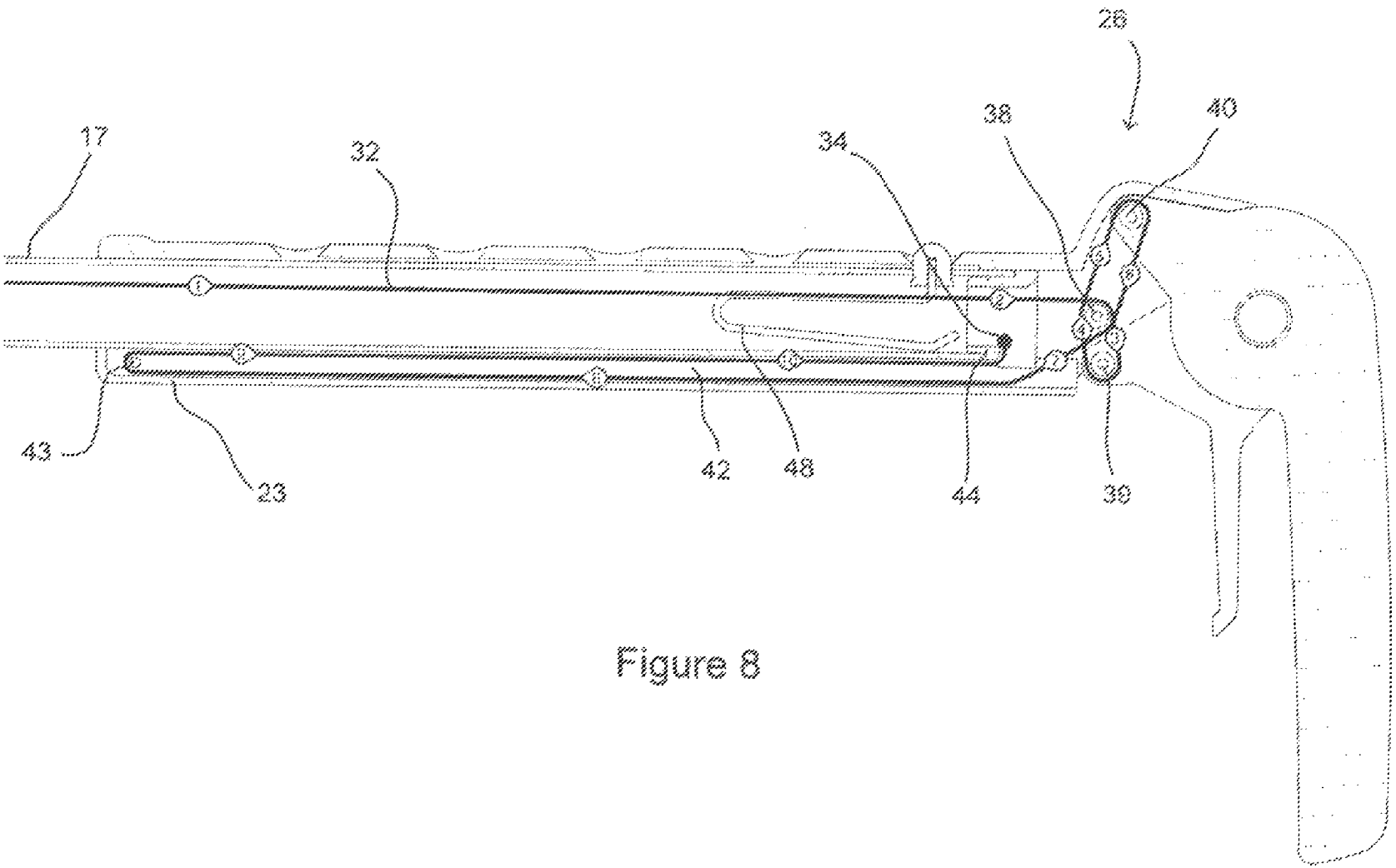
FIG. 8 is a detailed cross-section of part of the stick of FIG. 7, showing in detail the path of the actuation line.

The path of the actuation line 32 is shown in more detail in FIG. 8. For clarity, numbers have been superimposed on the actuation line 32 and the path will be described with reference to those numbers.

1) The actuation line 32 runs along the shaft 17 from its first end via the lower turning point 36 (not shown in FIG. 8) towards the actuator assembly 26.
2) The actuation line 32 enters the actuation assembly 26 and passes around a central turning point 38. Preferably this central turning point 38 is a fixed turning point.
3) The actuation line 32 passes from the central turning point 38 to and around a moveable turning point 39.
4) The actuation line 32 passes from the moveable turning point 39 back to and around the central turning point 38.

5) The actuation line 32 passes from the central turning point 38 to and around another moveable turning point 40.

6) The actuation line 32 passes from the moveable turning point 40 back to and around the central turning point 38.

7), 8) The actuation line 32 passes from the central turning point 38 towards and along a passage 42 formed between the main shaft 17 and the outer sleeve 23.

9) The actuation line passes around a turning point 43 and runs back along the passage 42.

10) The actuation line 32 travels towards its second end 34 where it is attached to a fixing element 44.

The actuation line repeatedly passes the central turning point 38. Each pass may be offset laterally from the others to prevent tangling or wear between different parts of the actuation line 32. Suitable guides or grooves may be provided.

In the configuration of FIG. 7 the tension of the actuation line maintains the jaw 15 in the stowed position against the bias provided by a spring 46.

Figure 9:
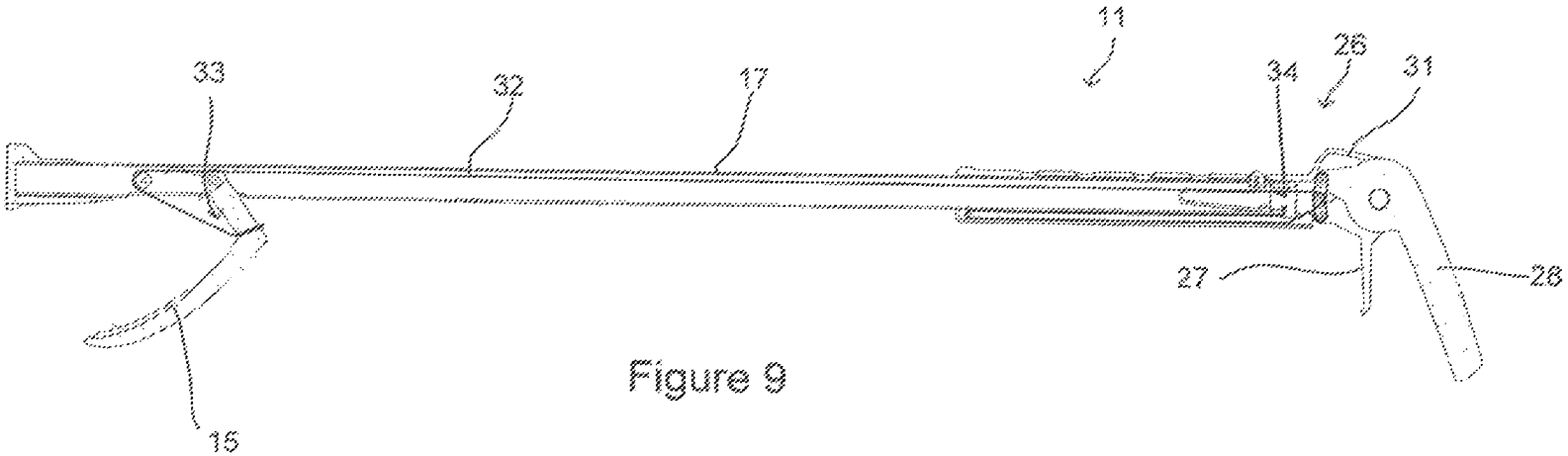
FIG. 9 is a further cross-section of the stick of FIG. 7, showing the pickup mechanism in an unstowed position.

In order to unstow the pickup mechanism, a user releases the stop 31. This can be achieved using a suitable button or any other suitable arrangement. This allows the handle 28 to move from the neutral position of FIG. 7 to an operative position as shown in FIG. 9. The first movable turning point is carried by the handle 28, so this results in movement of the movable turning point to the position shown in FIG. 9. The movement of the first movable turning point 40 releases tension on the actuation line 32, allowing the pickup jaw 15 to move outward under the bias of the spring 46 to the unstowed position shown in FIG. 9.

From this position, operation of the trigger will result in actuation of the pickup jaw 15. A user can operate the trigger 27, moving it to the position shown in FIG. 10. The second movable turning point 39 is carried by the trigger 27, so this results in movement of the second moveable turning point 39. This increases the path length of the actuation line in the actuator assembly, such that tension is carried by the actuation line 32 to move the pickup jaw against the bias provided by the spring 46 back towards the shaft 17 and rubber foot 13 to a pickup position. Thus objects can be picked up between the rubber foot 13 or shaft 17 and the jaw 15.

Note that the pickup jaw's pickup position (FIG. 10) is preferably the same as the stowed position (FIG. 7), but similar devices can be contemplated where the stowed and pickup positions are different. Note also that the second movable turning point 39 is the last movable turning point that the actuation line passes about before running towards the pickup mechanism. This provides the least possible friction in operation of the trigger, so provides good "feel" in the trigger mechanism.

On release of the trigger, the device will move back to the position of FIG. 9. The pickup mechanism can again be actuated by operation of the trigger, or the stick 11 can be put into the walking stick configuration of FIG. 7 by turning the handle 28 back to the position of FIG. 7. This will move the first movable turning point and force the pickup jaw 15 back to the stowed position against the bias of the spring 46.

This the first actuator effectively controls configuration of the stick as either a walking stick or a pickup stick. Only when the first actuator is in the operative position, the second actuator may be used to operate the pickup mechanism.

The Applicant's stick preferably also has an adjustable length shaft. This allows the stick 11 to be adjusted for users of different heights. The adjustable shaft will now be described with reference to FIGS. 7 and 11. FIG. 7 shows the stick 11 in its shortest configuration. A projection 25 extends through a single hole formed in the inner sleeve of the shaft 17 and through one of the holes 24 formed in the outer sleeve 23 of the shaft 17. This therefore sets the length of the shaft 17. The projection 25 is preferably mounted on a spring 48 such that it is biased outwards.

Figure 11:
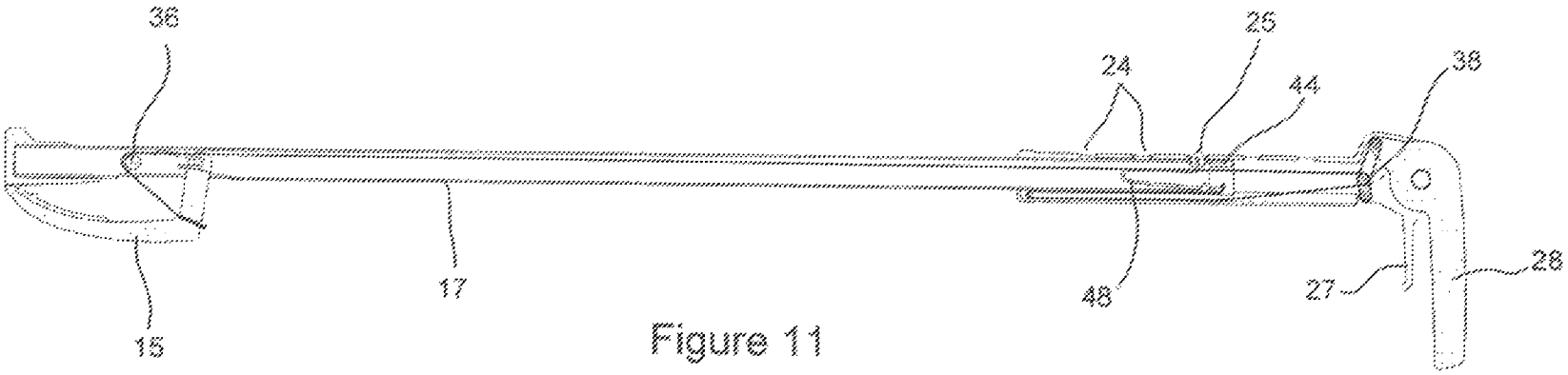
FIG. 11 is a further cross-section of the stick of FIG. 7, illustrating operation of the adjustable length shaft.

In order to adjust the length of the shaft, a user simply pushes inwards on the projection 25 and slides the inner sleeve of the shaft 17 with respect to the outer sleeve 23. The projection will slide outwards again when the hole in the inner sleeve is again aligned with one of the holes 24 in the outer sleeve 23. FIG. 11 shows the stick 11 in a longer configuration. Many other types of fixing mechanism for fixing the length of the shaft may be suitable and would occur to the skilled reader.

The Applicant's stick 11 is designed such that this length adjustment does not affect operation of the pickup mechanism. Lengthening or shortening the shaft 17 in this way results in an increase or decrease in the distance between the lower turning point 36 and central turning point 38. However, the fixing element 44 is carried by the top of the inner sleeve of shaft 17. Thus the Applicant's device compensates for this increase or decrease in the distance between the lower turning point 36 and central turning point 38 with a corresponding decrease or increase in the distance between the second end 34 of the actuation line 32 and the turning point 43. Thus the total path length of the actuation line is unchanged and operation of the stick's mechanism is unaffected by the shaft length alteration.

Figure 12:
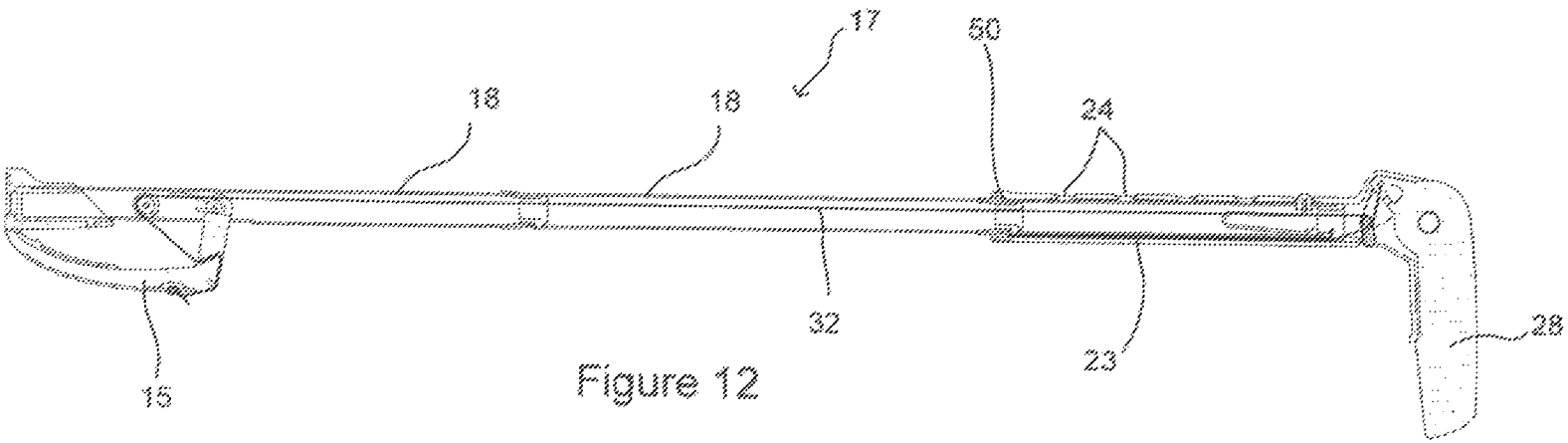
FIG. 12 is a cross-section along the length of a stick according to a further embodiment, in a walking stick configuration.

As discussed above the Applicant's stick 11 can also be configured as a folding combined walking and pickup stick. FIG. 12 shows a stick 11 where the shaft 17 is formed by a number of sections 18 connected by ferrule-type joints 19. The skilled reader would understand that other types of joint may also be suitable.

In order for the sections 18 of the shaft 17 to be taken apart, the tension on the actuation line 32 must be released. This can be achieved from the position of FIG. 7 by holding the pickup jaw in its stowed position and moving the handle 28 from its neutral position (FIG. 7) to its operative position (FIG. 9).

Alternatively, release of actuation line tension can be achieved from the position of FIG. 9 by manually closing the pickup jaw 15.

Figure 10:
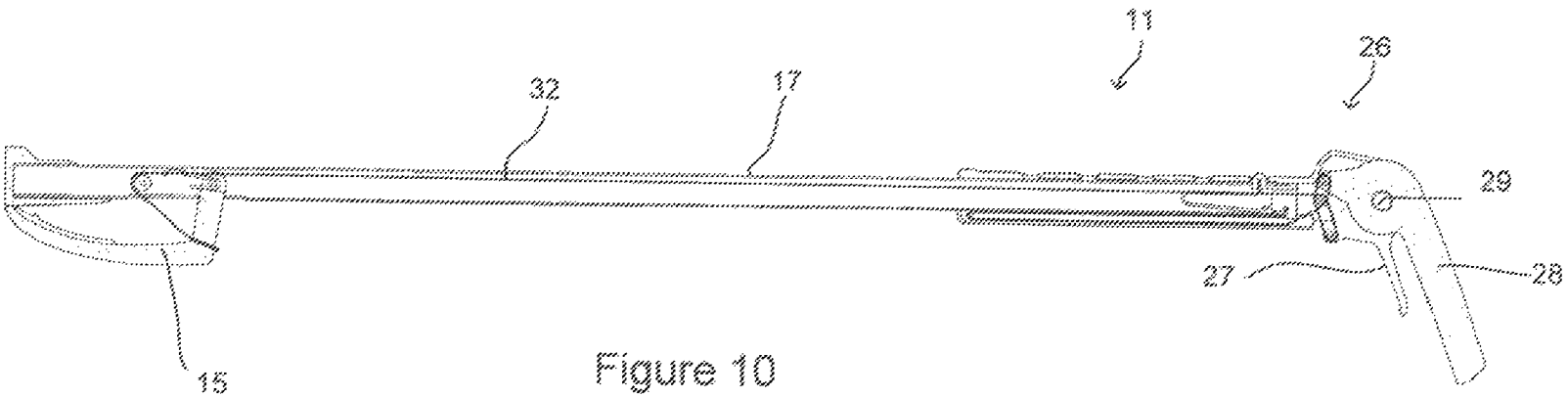
FIG. 10 is a further cross-section of the stick of FIG. 7, showing the pickup mechanism in a pickup position.

Alternatively, release of actuation line tension can be achieved from the position of FIG. 10 by holding the pickup jaw in its pickup position and releasing the trigger 27.

Any one of these actions shortens the overall path of the actuation line, allowing the joints to be taken apart and the shaft 17 folded.

In the unfolded state, the shaft sections may be held together by one or more lengths of elastic cord, providing a tension force to keep the ferrule joints together. Elastic cord may also provide a bias to the handle 28, and this may be the same elastic cord used to keep the ferrule joints together. For example, an elastic cord may run from the top of the lowest shaft section 18 up the shaft to a connection point on the handle lever.

Also in FIG. 12, the turning point 43 is provided by a circumferential groove rather than a pin or bush as used in FIGS. 7 to 11. The actuation line passes down a passage between the inner and outer sleeves of the shaft 17, but instead of passing around a pin or bush passes once around the circumference of the inner sleeve of the shaft 17, in a groove 50 formed on the inner surface of the outer sleeve 23. This allows the outer sleeve 23 to have a slimmer profile, since no space is required for a pin or bush.

FIG. 12 also shows a turning point formed by an aperture 52 on the handle lever. The actuation line passes through this aperture.

Figure 13:
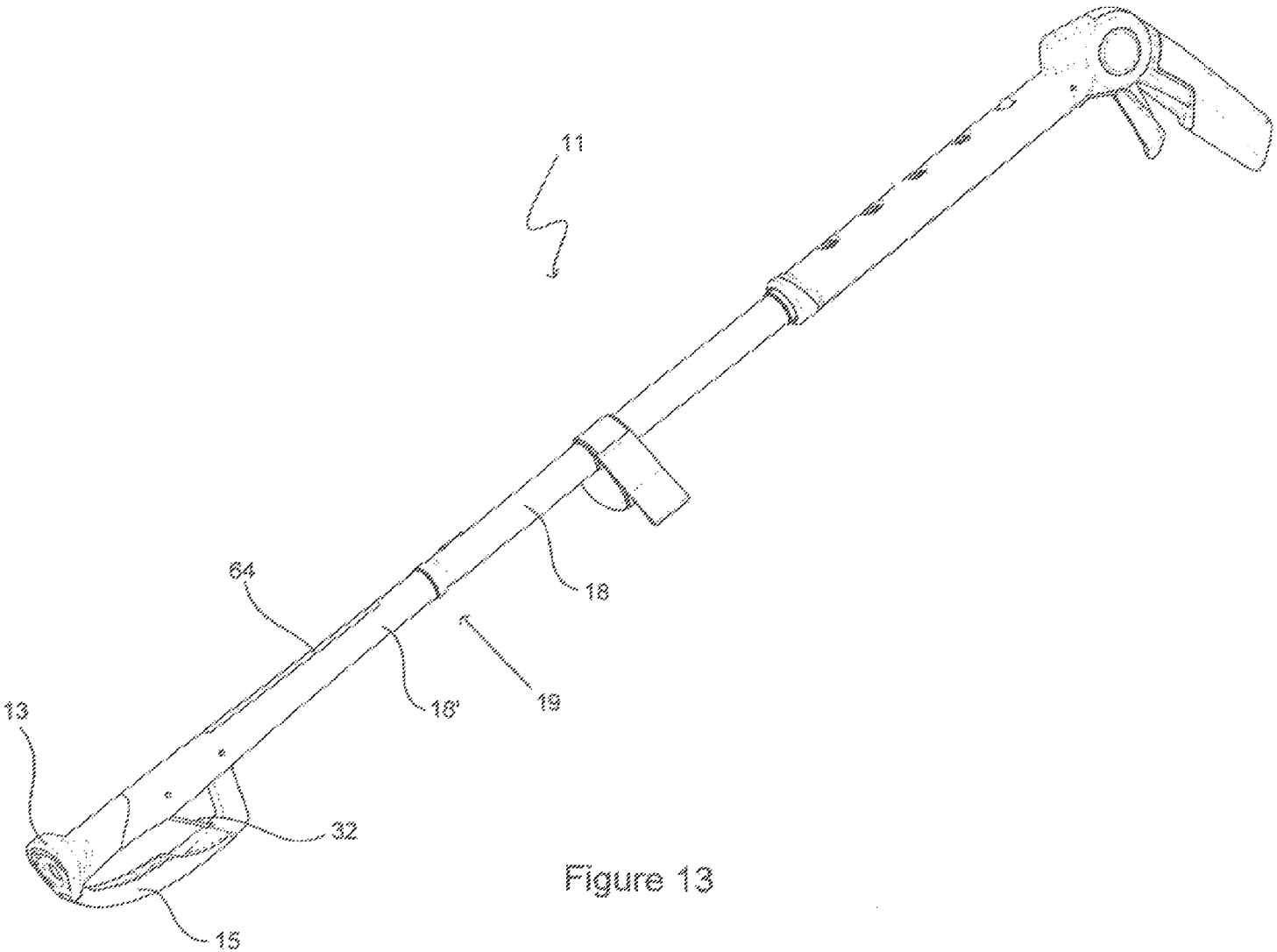
FIG. 13 is a perspective view of a stick according to a further embodiment.
Figure 14:
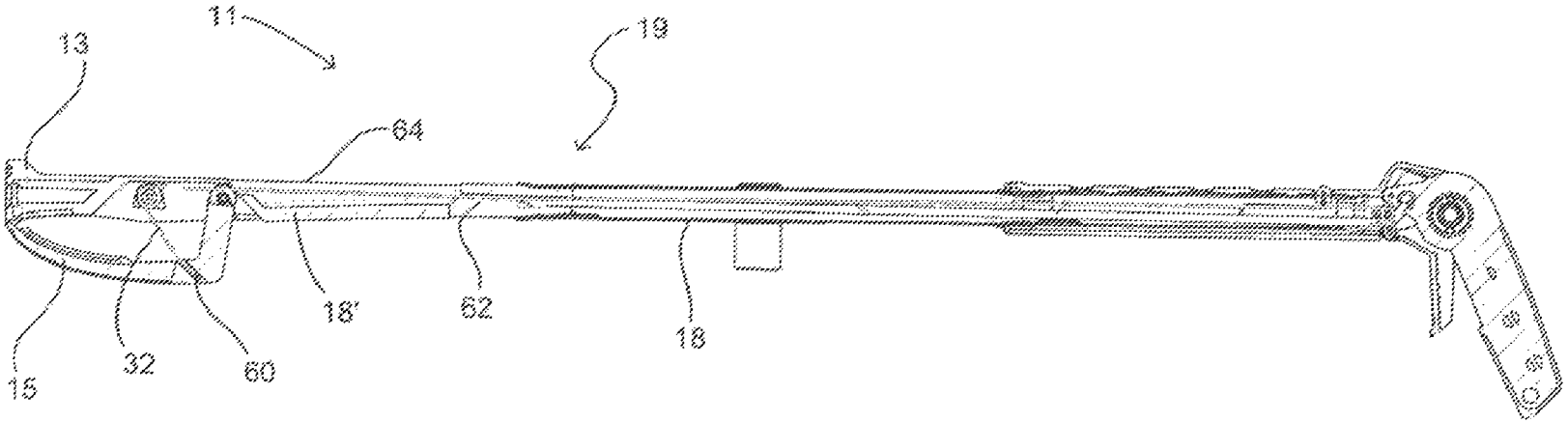
FIG. 14 is a cross-section through the stick of FIG. 13.

FIG. 13 shows a further embodiment, which functions in a generally similar manner to the folding sticks discussed above. As is clear in FIGS. 13 and 14 the actuation line 32 is received in a hole 60 in the jaw 15. A suitable plug may be provided on the end of the actuation line 32 for interaction with the hole 60, which may have any suitable arrangement of projections or other formations on its inside surface.

Figure 15:
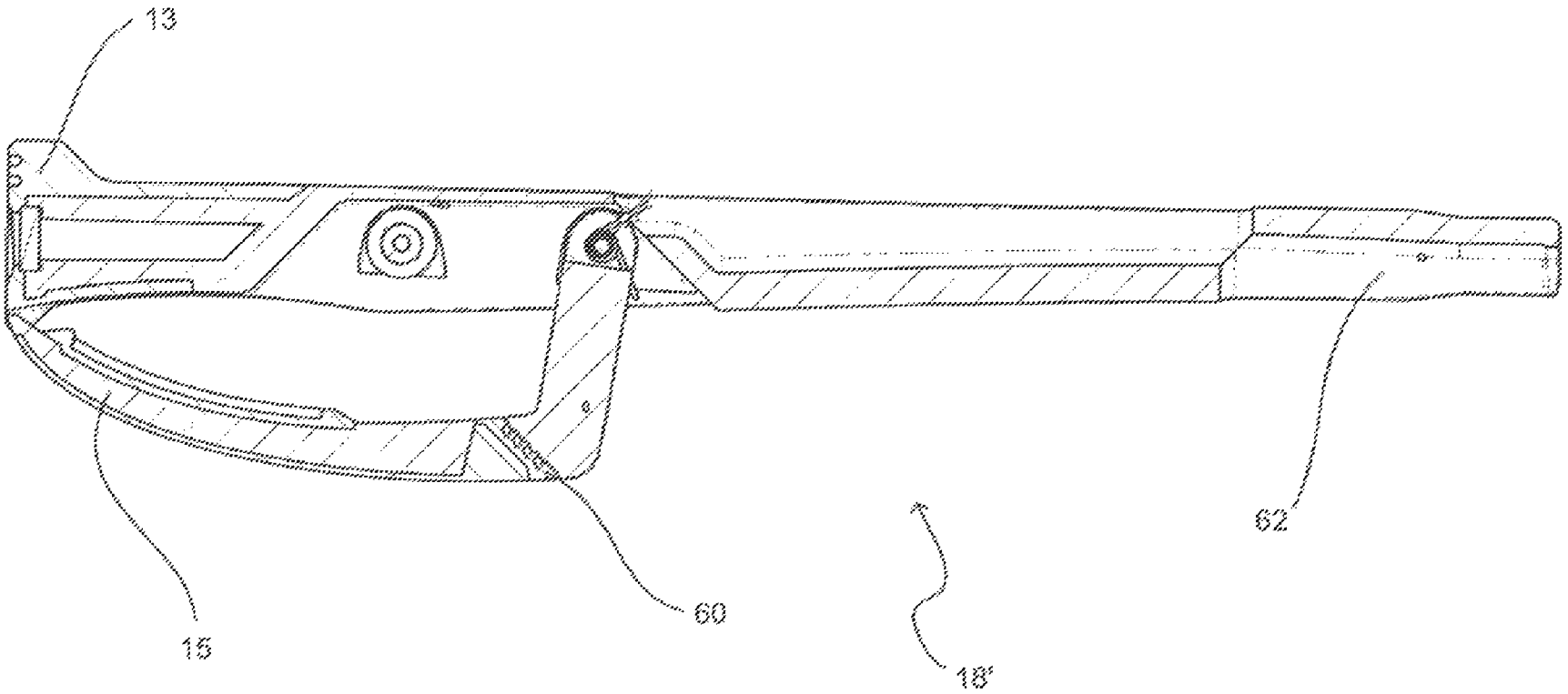
FIG. 15 is a more detailed cross-section of a lower section of the stick of FIG. 13.
Figure 16:
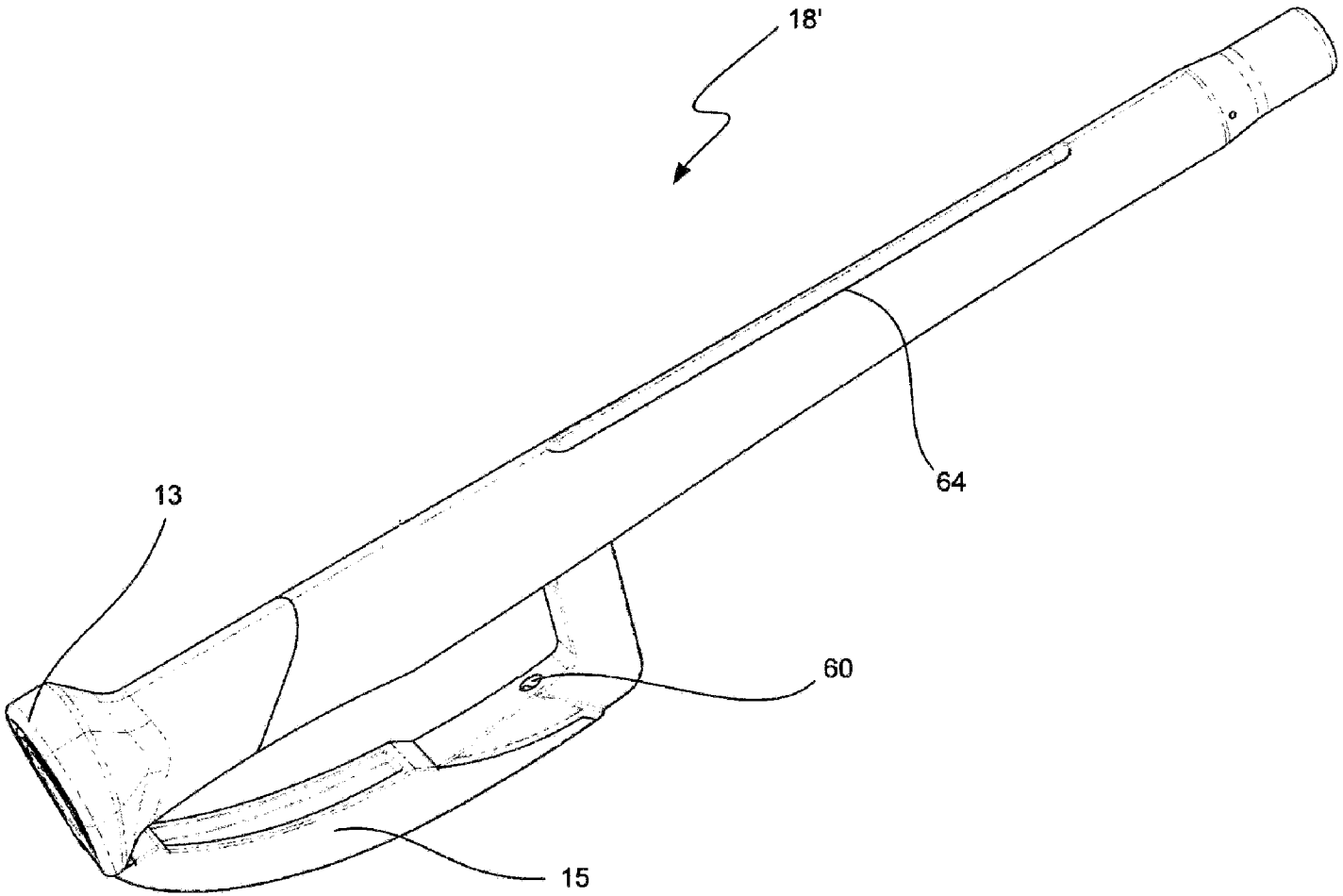
FIG. 16 is a perspective view of the lower section of FIG. 15.

The lowermost section 18' of the stick may be formed as a polymer with an overmoulded foot 13. In this embodiment the lowermost section 18', which is shown in more detail in FIGS. 15 and 16 has a slot 62 formed at its top end. Enough of the surrounding material remains to provide a robust attachment to the next section 18 at joint 19, but the slot 62 allows the actuation line to move into the slot when the stick is folded. This provides several advantages.

Whereas in other designs it may be necessary to release the lower end of the actuation line 32 for folding, in this embodiment the cord length can be set in the factory. The user need never adjust the cord or cord length unless cord stretch over time requires a slight tightening from time to time. This eliminates one operation when folding or unfolding the stick. The overall construction of the lower section 18' also reduces the number of parts and tooling requirements. The slot 64 on the other side of the lower section 18' is provided only for manufacturing purposes.

The actuation line may be formed from any suitable material, but is preferably a non-stretching material, such as braided nylon cord, sash cord or the like.

The other components may be formed from any suitable material, including steel or suitable plastics such as engineering polymers that provide durable structural properties as well as good aesthetic properties. An ABS-PC blend, nylon or acetal may be suitable. The shaft or shaft sections may be formed from aluminium While the invention has been described with reference to embodiments in which a single actuator controls movement of a single movable turning point, each actuator could control movement of two or more movable turning points. Similarly, while the embodiments described have one end of the actuation line fixed and the other end connected to the pickup mechanism, both ends could move in some embodiments.

Movement of parts of the stick can be caused by applied tension from the actuation line. Alternatively, release of tension in the actuation line may allow movement of parts under other forces, such as the bias applied by spring 46.

The Applicant's invention therefore provides a combined walking and pickup stick where movement of the pickup mechanism is caused or allowed by movement of movable turning points. Not only can the pickup mechanism be easily operated, but the stick can have an adjustable length, with any length adjustments being automatically compensated for to eliminate any effect on operation of the pickup mechanism. The Applicant's stick may also have a folding shaft for easy storage or transportation. On reassembly of the folding shaft the stick is instantly ready for use, as no reattachment or manual tightening of the actuation line is required.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A combined walking and pickup stick including:

a. a shaft;

b. a pickup mechanism at or near one end of the shaft;

c. an actuator assembly at or near the other end of the shaft;

d. an actuation line running from the actuator assembly along the shaft to the pickup mechanism;

e. two or more movable turning points at least partly defining a path of the actuation line, each movable turning point having a movable position or axis;

wherein the actuator assembly includes first and second actuators each configured, in use, to cause movement of the position or axis of one or more of the moveable turning points, thereby altering the path of the actuation line such that one or both ends of the actuation line are either moved by applied tension or allowed to move by released tension;

wherein the first actuator controls configuration of the combined walking and pickup stick as either a walking stick or a pickup stick and the second actuator controls the pickup mechanism.

2. A combined walking and pickup stick as claimed in claim 1 wherein the first and second actuators include two levers.

3. A combined walking and pickup stick as claimed in claim 2 wherein the two levers rotate about a common pivot axis.

4. A combined walking and pickup stick as claimed in claim 1 wherein the first actuator is a handle and the second actuator is a trigger.

5. A combined walking and pickup stick as claimed in claim 1 wherein movement of the first actuator from a neutral position to an operative position results in movement of one or more of the movable turning points, the resulting alteration in the path of the actuation line causing or allowing movement of the pickup mechanism from a stowed position, in which the stick is configured as a walking stick, to an unstowed position, in which the stick is configured as a pickup stick.

6. A combined walking and pickup stick as claimed in claim 5 wherein, when the first actuator is in the operative position and the pickup mechanism is in the unstowed position, movement of the second actuator from a first position to a second position causes or allows movement of the pickup mechanism from the unstowed position towards a pickup position.

7. A combined walking and pickup stick as claimed in claim 5 wherein movement of the second actuator from the first position to the second position is possible only when the first actuator is in the operative position.

8. A combined walking and pickup stick as claimed in claim 5 wherein movement of the first actuator from the operative position to the neutral position results in movement of one or more of the movable turning points, the resulting alteration in the path of the actuation line causing or allowing movement of the pickup mechanism from the unstowed position to the stowed position.

9. A combined walking and pickup stick as claimed in claim 1 wherein the last movable turning point about which the actuation line passes before running to the pickup mechanism is moved by the second actuator.

10. A combined walking and pickup stick as claimed in claim 1 wherein the shaft includes a number of joints such that it can be folded, disassembly of the joints for folding of the shaft being enabled by release of tension through movement of one or more of the movable turning points and/or manual movement of the pickup mechanism.

11. A combined walking and pickup stick as claimed in claim 1 wherein the shaft is an adjustable length shaft.

12. A combined walking and pickup stick as claimed in 11 wherein adjustment of the length of the shaft results in an increase or decrease in the length of an actuation line path between the actuator assembly and the pickup mechanism and a corresponding decrease or increase in the length of an actuation line path elsewhere in the stick such that the total actuation line path length is unchanged and operation of the pickup mechanism is unaffected by the adjustment of the length of the shaft.

13. A combined walking and pickup stick as claimed in claim 12 wherein the increase and decrease of actuation path lengths occur as a consequence of adjustment of the length of the shaft, without the need for manual adjustment of actuator line path or length.

14. A combined walking and pickup stick as claimed in claim 11 further including a fixing arrangement configured to fix the length of the shaft at a desired length.

15. A combined walking and pickup stick including:

a. an adjustable length shaft;

b. a pickup mechanism including a jaw at or near one end of the shaft;

c. an actuator assembly at or near the other end of the shaft, the actuator assembly including first and second pivoted actuators; and d. an actuation line;

wherein:

the actuation line is fastened at a first end to a point on the shaft and runs from the first end via the actuator assembly and along the shaft to the pickup mechanism, a second end of the actuation line being connected to the pickup mechanism such that, in use, operations of the first and second actuators result in movement of the actuation line and the actuation of the pickup mechanism;

and adjustment of the length of the shaft results in an increase or decrease in the length of an actuation line path between the actuator assembly and the pickup mechanism and a corresponding decrease or increase in the length of an actuation line path elsewhere in the shaft such that the total actuation line path length is unchanged and operation of the pickup mechanism is unaffected by the adjustment of the length of the shaft.

16. A combined walking and pickup stick as claimed in claim 15 wherein the increase and decrease of actuation path lengths occur as a consequence of adjustment of the length of the shaft, without the need for manual adjustment of actuator line path or length.

17. A combined walking and pickup stick as claimed in claim 15 further including a fixing arrangement configured to fix the length of the shaft at a desired length.

* * * * *